United States Patent [19]

Billner

[11] Patent Number: 4,731,986

[45] Date of Patent: Mar. 22, 1988

[54] PROCESS AND DEVICE FOR OPEN-END FRICTION SPINNING

[75] Inventor: Werner Billner, Ingolstadt, Fed. Rep. of Germany

[73] Assignee: Schubert & Salzer, Ingolstadt, Fed. Rep. of Germany

[21] Appl. No.: 875,555

[22] Filed: Jun. 18, 1986

[30] Foreign Application Priority Data

Jun. 18, 1985 [DE] Fed. Rep. of Germany ..... 3521756

[51] Int. Cl.[4] ..... D01H 7/898; D01H 7/892; D01H 1/135

[52] U.S. Cl. ..... 57/401; 57/413; 57/415

[58] Field of Search ..... 57/5, 327, 400, 401, 57/408, 409, 411, 413, 415

[56] References Cited

U.S. PATENT DOCUMENTS

| | | | |
|---|---|---|---|
| 4,281,507 | 8/1981 | Didek et al. | 57/401 |
| 4,537,021 | 8/1985 | Parker | 57/401 |
| 4,557,105 | 12/1985 | Brockmanns et al. | 57/401 |
| 4,571,932 | 2/1986 | Stahlecker et al. | 57/401 |
| 4,573,312 | 3/1986 | Brockmanns et al. | 57/411 X |
| 4,574,572 | 3/1986 | Fehrer | 57/401 X |
| 4,590,756 | 5/1986 | Stahlecker | 57/401 |
| 4,625,505 | 12/1986 | Raasch et al. | 57/401 |

FOREIGN PATENT DOCUMENTS

| | | |
|---|---|---|
| 2943063 | 5/1980 | Fed. Rep. of Germany . |
| 3300636 | 7/1984 | Fed. Rep. of Germany . |

*Primary Examiner*—John Petrakes

*Attorney, Agent, or Firm*—Dority & Manning

[57] ABSTRACT

In an open-end friction spinning process provisions are made for the fibers to be fed tangentially onto the surface of a hollow friction roller, at an angle to the longitudinal axis of said roller, whereby the fibers reach the spinning wedge in this position. In this manner, the fibers are arranged at a predetermined angle as they go from the fiber feeding channel to the spinning wedge and are brought into contact with the yarn end in this position which facilitates the joining process.

16 Claims, 5 Drawing Figures

PROCESS AND DEVICE FOR OPEN-END FRICTION SPINNING

BACKGROUND OF THE INVENTION

The invention concerns a process for open-end friction spinning where the fibers are fed on the casing surface of a friction roller (designed as a suction roller) and where the fibers are conveyed onto the casing surface to a spinning wedge in which they are twisted together into a yarn, and a device for carrying out the process.

While yarn spun with a friction spinning device can be made at high production speeds, the yarn quality still remains unsatisfactory. This is caused by insufficient drawing of the fibers into the fiber joint. It has been proposed in German Patent No. DE-OS 2,943,063 to feed the fibers at an angle to the draw-off direction of the yarn, where the air stream flows in such manner in the vicinity of the yarn forming surface as to cause at least a portion of the fibers to be redirected as they approach the yarn forming surface, their new direction being more closely parallel to the axis of the drawn-off yarn. It was found, however, that the problem of yarn quality could not be solved by means of this device.

In another known open-end friction spinning device, the untwisted fibers are fed by a fiber feeding channel, installed at a distance from the wedge-shaped wedge of a suction roller, so that the fibers are subjected to a change of direction at the edge of the feeding channel outlet before they reach the wedge German Patent No. DE-OS 3,300,636. This change of direction is intended to cause drafting or drawing of the fibers. However, this measure, also, does not yield the expected results.

SUMMARY OF THE INVENTION

It is the objective of the present invention to improve feeding of the fibers into the spinning wedge and thereby the quality of the yarn. The invention attains this objective by feeding fibers in direction of rotation onto the casing surface at a tangent and in a direction inclined to the generating line of the friction roller, whereby the fibers reach the spinning wedge in this position.

It has been shown that it does not suffice to avoid a build-up of fibers as they arrive at the yarn end which is formed in the spinning wedge so that drawn and parallel oriented fibers may be joined to said yarn end. An essential element of the invention is the recognition of the fact that a defined angle is needed at which the drawn fibers must come into contact with the yarn end so that proper incorporation of the fibers into a yarn may be obtained. It way found that the fibers roll themselves into a so-called "cummerbund" if they arrive at an angle of 90°, for example. On the other hand, feeding of the fibers parallel to the longitudinal axis of the friction roller is equally undesirable as the fibers do not loop around each other but remain mostly in a parallel position, without uniform twisting about each other. In either case, the quality of the yarn obtained is unsatisfactory.

In the process according to the present invention, the fibers are conveyed in optimal fashion to the yarn end so that uniform twisting and joining of the fibers takes place, resulting in a usable yarn. The fibers are oriented at a predetermined angle as early as on their passage from the fiber feeding channel into the spinning wedge and they are brought into contact with the yarn end in this position so that they loop around said yarn end for the creation of a good joint or splice.

In an advantageous further development of the invention, the fibers fed onto the casing or generated surface of the friction roller are held fast upon it and are conveyed through rotation of the friction roller into the spinning wedge. At the same time, the holding force can be selected so as to bring the fibers into the spinning wedge at the peripheral speed of the casing surface of the friction roller or sliding obliquely across the casing surface. It has been found useful to draw off the yarn from the spinning wedge in the same main direction as that determined by the position of the fibers on the friction roller.

The device made according to the invention is characterized in that the fiber feeding channel is equipped with a sidewall which extends in the direction of the spinning wedge and in that the side of the fiber feeding channel opposite to this sidewall is formed by the adjacent surface of the friction roller. The fibers thus reach the surface of the friction roller at a tangent and are drawn on their passage from the fiber feeding channel to the surface.

In order to orient the fibers in a direction beneficial to the process of joining them to the yarn end as soon as they arrive upon the casing surface, the fiber feeding channel is inclined with respect to the generating line of the friction roller. A screening of the fibers against interfering influences, in particular against extraneous air currents, is obtained if the sidewall extending towards the spinning wedge reaches into said spinning wedge. This screening effect is optimal if the sidewall reaches almost into the zone of the yarn-forming line in the spinning wedge. In order to ensure proper guiding of the fibers around the periphery of the friction roller, the sidewall of the fiber feeding channel is adapted to the curvature of the friction roller. Furthermore, it is possible to thereby give the fiber feeding channel a flatter configuration. In order to avoid acceleration of the fibers within the fiber feeding channel, the cross-sectional area of the fiber channel is constant from its inlet opening to its outlet.

The orientation of the fibers for proper joining is considerably improved if the feeding angle of the fiber feeding channel corresponds to the predetermined angle at which the rows of perforations are arranged in relation to the generating line of the friction roller. Experience has shown here that the arrangement of the perforation rows of the hollow suction friction roller at an angle of 40° and 60° yields the best results.

The depositing and conveying of the fibers onto the roller surface in the desired position, angled towards the spinning wedge, is further facilitated if the contour of the suction opening of the suction insert, installed within the hollow suction friction roller, follows the contour of the outlet of the fiber feeding channel. In order to save air consumption, provisions are made for the force of suction exerted upon the fibers to increase from the initial point of the fiber contact on the roller surface up to the spinning wedge.

BRIEF DESCRIPTION OF THE DRAWINGS

The invention will be more readily understood from a reading of the following specification, and by reference to the accompanying drawings forming an integral part thereof, wherein an example of the invention is shown, and wherein.

DESCRIPTION OF A PREFERRED EMBODIMENT

Figure 1:
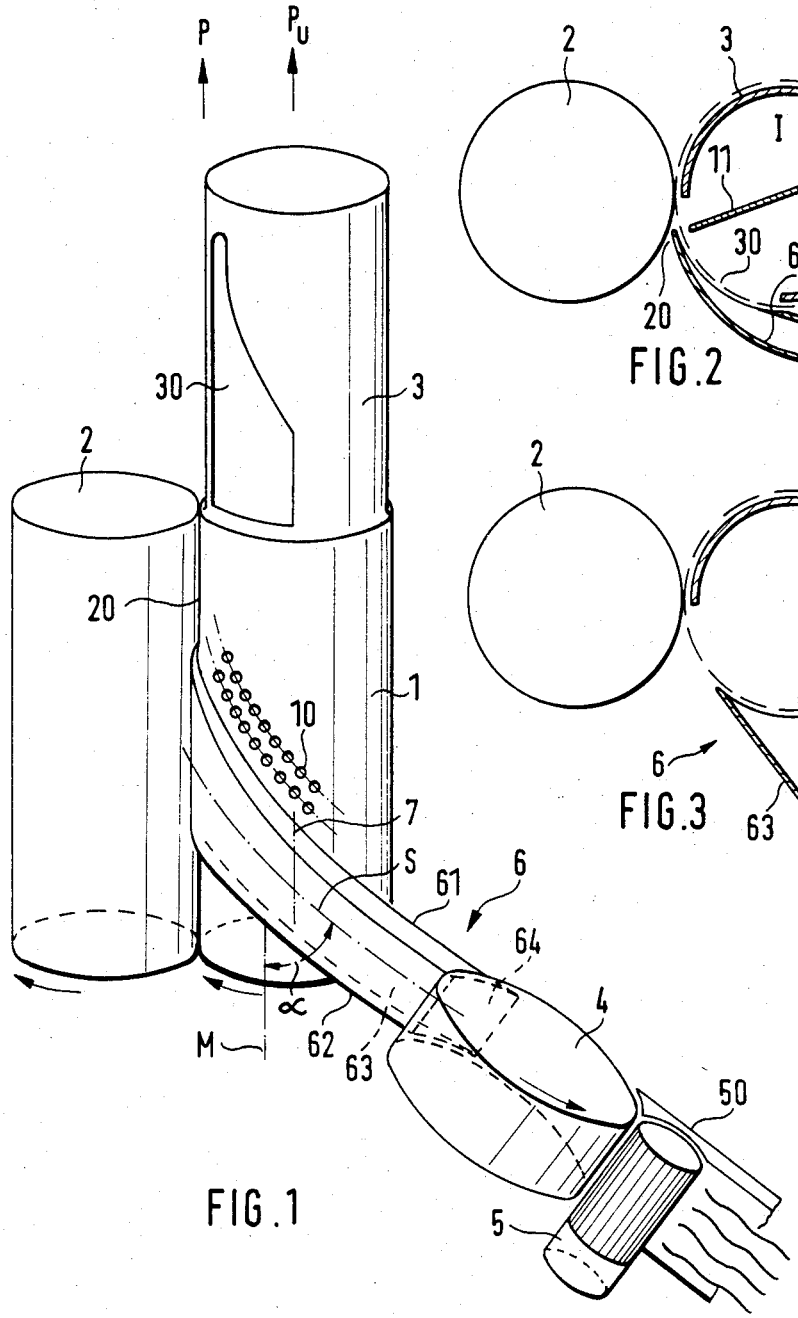
FIG. 1 is a perspective view illustrating an open-end friction spinning apparatus of the invention.
Figure 2:
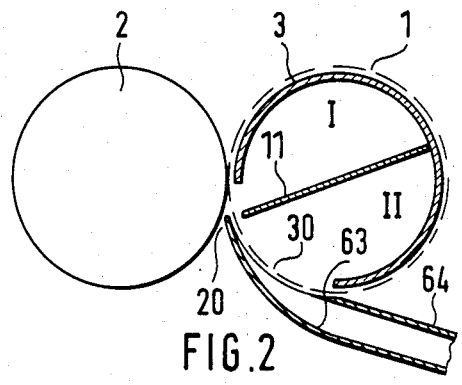
FIG. 2 is a diagrammatic end view of the friction rollers and the fiber feeding channel shown in FIG. 1.

Referring now to FIG. 1 and 2, the two parallel friction rollers 1 and 2, in close proximity of each other, form a spinning wedge 20 (FIG. 2) and are driven in the same rotational direction by such means as, for example, a tangential belt (not shown). The friction roller 1 is designed as a hollow suction roller and has a casing with rows of perforations 10 in which a stationary suction insert 3 having a suction opening 30 is fixedly installed.

To show the suction opening 30 more clearly, the suction insert 3, of FIG. 1 is pulled out of the casing. The suction insert 3, as indicated by arrow $P_u$, is connected in the conventional manner to a negative pressure device (not shown). Friction roller 2 has a closed casing but it too can be designed as a suction roller, if desired.

The fiber material to be spun into the yarn is separated into single fibers by means of a carding roller 4 which is preceded by a feeding roller 5 with a feeding table 50. These individual fibers are fed through a fiber feeding channel 6 onto the perforated casing of the friction roller 1.

The fiber feeding channel 6 is rectangular in cross-section and is formed by end walls 61 and 62 and by the sidewalls 63 and 64 connecting walls 61 and 62. The sidewall 63 on the side of friction roller 2 extends towards the spinning nip 20 and reaches into it, as shown in FIG. 2. It is preferably adapted to the curvature of the friction roller 1. The sidewall 63 thus ensures, first of all, that the air stream entering suction opening 30 flows essentially, and only, through fiber feeding channel 6, and furthermore, contributes in the secure guiding of the fibers around the periphery of friction roller 1. To ensure that the joining zone is also free from extraneous air currents that may interfere with the fibers, the sidewall 63 is preferably extended so far into the spinning nip 20 as to almost reach into the yarn-forming zone.

Figure 3:
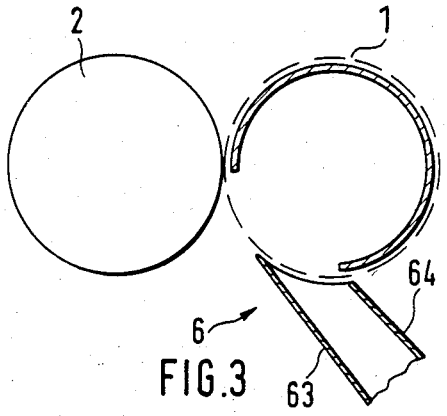
FIG. 3 is an end view similar to that of FIG. 2 showing an alternative configuration of the fiber feeding channel.

Depending upon the given technological spinning conditions it may, however, suffice to give sidewall 63 a straight configuration and to have it end before it reaches the spinning nip 20, as is shown in FIG. 3. In either case however, sidewall 64 terminates at the contact line 7 with friction roller 1 (FIG. 1) so that, starting at that line, the side of fiber channel 6 opposite to sidewall 63 is open in the direction of friction roller 1, whereby the casing surface of friction roller 1 replaces sidewall 64 (FIGS. 2, 3).

Figure 5:
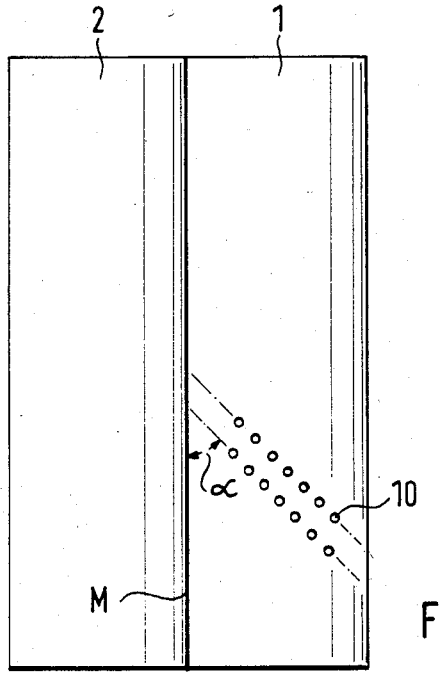
FIG. 5 is a side view of the two friction rollers.

Furthermore, the fiber feeding channel 6 is inclined in relation to the casing or generating line M of the friction roller 1, preferably in such manner as to have its center line S (FIG. 1) extend at an angle $\alpha$ at which the fibers are fed. In order to maintain the feeding direction given by the fiber feeding channel 6, the perforation rows 10 of friction roller 1 are also inclined at this same angle $\alpha$ in relation to the casing line M and are thereby slanted with respect to the yarn draw-off line (FIG. 5). Experience has shown that an angle $\alpha$ of 40° to 60° yields the best spinning results, as does the adaptation of the contour of the suction opening 30 of suction insert 3 to the contour of the outlet of fiber feeding channel 6. The contour of suction opening 30 shown in FIG. 1 matches the contour of the outlet of the fiber feeding channel 6 which opens towards friction roller 1. In this manner, a sufficiently strong fiber conveying air current is created in the fiber feeding channel 6 to convey the fibers onto the casing of friction roller 1. However, acceleration of the fibers during their travel through fiber feeding channel 6 is generally undesirable, and therefore said fiber feeding channel is shaped so that the area of its cross-section remains constant from its inlet opening up to its outlet.

In order to decrease the consumption of air, it is possible to provide for a suction air current of lesser force to draw and hold the fibers on the friction roller initially and to provide for a comparatively stronger suction air current in the spinning wedge. This is achieved, for example, by subdividing the suction insert 3 in the area of suction opening 30 by means of a separating wall 11 into sections I and II (FIG. 2), each connected to a source of negative air pressure of a different capacity.

Figure 4:
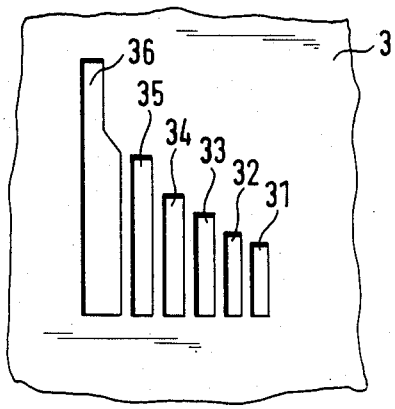
FIG. 4 is a plan view of an alternative suction distribution device.

Another possibility illustrated in FIG. 4, consists in replacing the suction opening 30 contour shown in FIG. 1 with a plurality of suction slits 31 to 36 of varying lengths and widths in such manner as to increase the suction effect from slit to slit from the initial point of fiber contact onto the roller surface to the point at which they are fed into the spinning wedge. In this case, for example, the slits may be connected to a common suction device by means of small suction ducts provided with throttling members.

In the spinning operation the fiber material, separated into separate fibers by the carding roller 4, is conveyed through the fiber feeding channel 6 to the friction roller 1 by the air current flowing towards the suction opening 30, whereby acceleration of the fibers within the channel is avoided through the utilization of a fiber feeding channel with a constant cross-sectional area. The feeding of the fibers onto the casing surface of friction roller 1 takes place in direction of rotation at a tangent to the casing surface, and therefore, without build-up of accumulating fibers, whereby the fibers slide on the casing surface in an inclined position with respect to the casing line or the longitudinal axis of the friction roller, following the predetermined inclination of the fiber feeding channel in relation to the casing or generating line of the friction roller. This position is of considerable advantage to the incorporation of the fibers into the yarn.

Optimal conditions is orienting the fibers exist if the feeding angle of the fiber feeding channel corresponds to the predetermined angle $\alpha$ at which the perforation rows 10 of the friction roller 1 are arranged, thereby enabling the fibers to orient themselves in accordance with said rows of perforations. The fibers are held fast in this position on the casing or generated surface of friction roller 1 by means of the suction air current and are conveyed into the spinning wedge through the rotation of the friction roller. To accomplish this, the fibers can be conveyed into the spinning wedge at the peripheral speed of the casing surface or by sliding obliquely over the casing surface, depending upon the suction force selected in the conveying zone.

As indicated by arrow P in FIG. 1, the yarn is preferably drawn off from the spinning wedge 20 in the direction essentially defined as the main direction by the position of the fibers. In this manner another direction change of the fibers, as they are drawn off in a different direction, is avoided.

It will be understood, of course, that while the form of the invention herein shown and described constitutes a preferred embodiment of the invention, it is not intended to illustrate all possible form of the invention. It will also be understood that the words used are words of description rather than of limitation and that various changes may be made without departing from the spirit and scope of the invention herein disclosed.

What is claimed is:

1. A process for open-end friction spinning yarn where carded fibers are fed into the spinning wedge formed by two friction rollers, at least one of which is hollow and has a perforated surface and suction means to draw fibers onto said perforated surface and to hold said fibers on said perforated surface and to convey said fibers into the spinning wedge to form a yarn generating line, comprising the steps of:

(a) carding said fiber to separate and to orient said fibers along their longitudinal axis;

(b) conveying said separated and oriented fibers in an air current to the surface of said hollow roller;

(c) depositing said oriented and separated fibers in the direction of rotation and tangentially onto said perforated surface of said friction roller, with the longitudinal axes of said fibers generally extending at an acute oblique angle to the generating line of said hollow friction roller, said angle also being acute with said generating line adjacent the end of said hollow friction roller opposite one end of said roller from which the twisted yarn is withdrawn;

(d) conveying said deposited fibers into the spinning wedge while maintaining said fibers on said perforated surface at the angle at which they were deposited thereon;

(e) twisting said fibers into yarn; and (f) withdrawing said yarn from said one end of said roller.

2. A process for open-end friction spinning yarn as set forth in claim 1, wherein the fibers are held on said perforated surface by suction and are conveyed into the spinning wedge by the rotation of the hollow friction roller.

3. A process for open-end friction spinning yarn as set forth in claim 2 wherein the fibers are conveyed into the spinning wedge at the peripheral speed of the hollow friction roller.

4. A process for open-end friction spinning yarn as set forth in claim 2 wherein the fibers glide obliquely over the perforated surface as they are conveyed into the spinning wedge.

5. A process for open-end friction spinning yarn as set forth in claim 1, wherein the yarn is drawn off from the spinning wedge along a line generally parallel to the longitudinal axis of said hollow friction roller and in the same direction as that determined by the position of the fibers on the friction roller.

6. An open-end friction spinning apparatus for spinning yarn from fiber comprising:

(a) a pair of friction rollers, driven in the same direction about parallel longitudinal axes, forming a spinning wedge where the surfaces of said friction roller are adjacent to each other, at least one of said friction rollers being hollow with a perforated surface;

(b) means for creating a suction within said hollow roller thereby drawing air through said perforations into said hollow roller and forming a yarn generating line:

(c) means for supplying open fibers, oriented with their longitudinal axes substantially parallel to each other, in an air current, and means for withdrawing twisted yarn from one end of said hollow roller;

(d) a channel for guiding said air current and said fibers onto the perforated surface of said hollow roller, having an opening with first and second end walls which extend around a portion of the periphery of said hollow roller, a top wall which extends about said roller and towards said spinning wedge, and a bottom wall which terminates adjacent the surface of the hollow roller at a point remote from said spinning wedge, the center line of said channel extending at an acute oblique angle to the generating line of said hollow friction roller, said angle also being acute with said generating line adjacent the end of said hollow friction roller opposite said one end of said roller from which the twisted yarn is withdrawn, whereby said perforated surface of said hollow roller acts as a bottom wall after the bottom wall terminates and said open fibers are deposited onto said perforated surface with their longitudinal axes at an acute oblique angle to said generating line.

7. An open-end friction spinning apparatus as set forth in claim 6 wherein the longitudinal axis of said channel intersects the longitudinal axis of said hollow friction roller at an angle which is between 40° and 60°.

8. An open-end friction spinning apparatus as set forth in either claim 6 or 7 wherein the top wall of said channel extends into said spinning wedge.

9. An open-end friction spinning apparatus as set forth in claim 8 wherein said top wall reaches substantially into the yarn generating line of the spinning wedge.

10. An open-end friction spinning apparatus as set forth in either of claims 6 or 7 wherein the hollow friction roller is provided with a suction insert in its interior which has an opening which conforms to the contour of the opening of said fiber feeding channel.

11. An open-end friction spinning apparatus as set forth in either of claims 6 or 7 wherein the suction force exerted upon the fibers increases from the point of their initial contact with the perforated surface of said hollow roller to the spinning wedge.

12. An open-end friction spinning apparatus, as set forth in claim 6, wherein the top wall of the fiber feeding channel is curved about the periphery of the hollow friction roller.

13. An open-end friction spinning apparatus as set forth in claim 12 wherein the cross-sectional area of the fiber feeding channel is substantially constant from its inlet to its outlet.

14. An open-end friction spinning apparatus as set forth in claim 13 wherein the perforations in said hollow friction roller are arranged in rows which extend at an oblique angle to the longitudinal axes of said hollow roller.

15. An open-end friction spinning apparatus as set forth in claim 14 wherein the longitudinal axis of said channel intersects the longitudinal axis of said hollow roller at the same predetermined oblique angle as that formed by the rows of perforations intersecting the longitudinal axis of said hollow roller.

16. An open-end friction spinning apparatus as set forth in claim 15 wherein the rows of perforations in said hollow friction roller and the longitudinal axis of said channel intersect the longitudinal axis of said hollow friction roller at an angle which is between 40° and 60°.

* * * * *